United States Patent [19]

Gasca Burges

[11] 4,441,757

[45] Apr. 10, 1984

[54] STRUCTURAL JOINT FOR FOLDING CHAIR

[76] Inventor: Jesus Gasca Burges, Avda. Madrid, 8 - 90 D, San Sebastian, Spain

[21] Appl. No.: 231,574

[22] Filed: Feb. 3, 1981

[30] Foreign Application Priority Data

Feb. 13, 1980 [ES] Spain ..... 248.575[U]
Jan. 22, 1981 [ES] Spain ..... 255.730[U]

[51] Int. Cl.[3] ..... A47C 4/00
[52] U.S. Cl. ..... 297/55; 108/115
[58] Field of Search ..... 297/55, 16, 41, 46; 108/6, 115

[56] References Cited

U.S. PATENT DOCUMENTS 3,705,744 12/1972 Piretti et al. ..... 297/55
3,756,166 9/1973 Piretti ..... 108/6

FOREIGN PATENT DOCUMENTS 2402610 9/1974 Fed. Rep. of Germany ..... 297/16

*Primary Examiner*—Francis K. Zugel
*Attorney, Agent, or Firm*—Wenderoth, Lind & Ponack

[57] ABSTRACT

A structural joint device for foldable chairs includes a combination of three tubular elements one of which has the shape of a rectangular frame forming the front legs and backboard of the chair. Another of the tubular elements has the form of a U-shaped tubular profile forming the back legs of the chair, while the third tubular element has the shape of a rectangular or quadrangular frame forming the seat frame of the chair. Lateral members of the three tubular elements are connected to one another by a pair of lateral structural joint devices. Each of the structural joint devices comprises a pair of identical rectangular prismatic pieces, one of which is partially inlaid and fixed to the corresponding interior face of the lateral member of the tubular element forming the front legs and backboard, while the other piece is placed facing the latter and is fixed on the lateral member of the tubular element forming the seat frame.

2 Claims, 10 Drawing Figures

STRUCTURAL JOINT FOR FOLDING CHAIR

Figure 1:
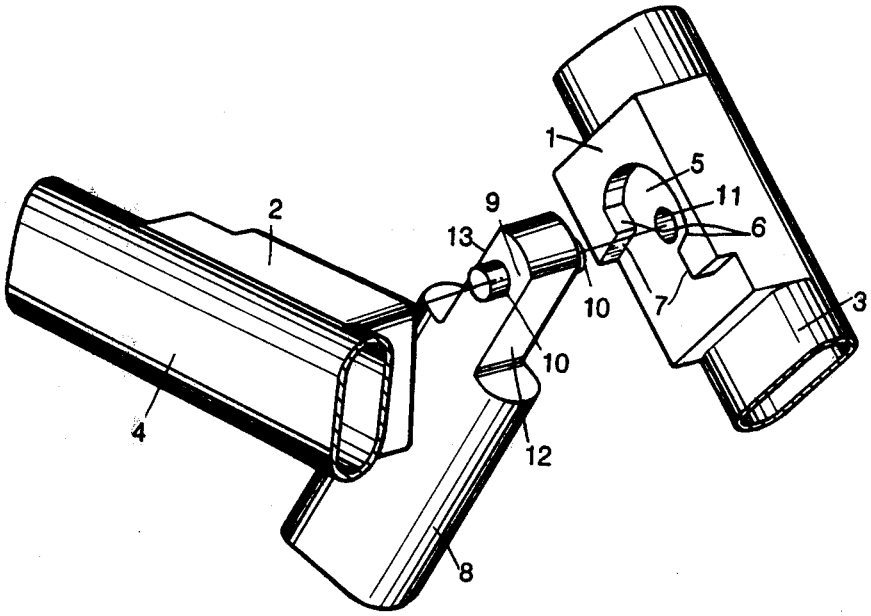

The present invention refers to a device of articulation for deflectable chairs known as scissors type. The general framework for this type of deflectable chairs is constituted by the combination of three elements; one having the function of front legs and backboard, which is preferably made with a rectangular cylindrical frame; another one having the function of back legs, constituted by a cylindrical U-shaped profile; the third element having the function of seat frame and formed by another rectangular or quadrangular cylindrical frame.

The side members of said elements constituting the general frame of the chair, are related to one another by a pair of structural joints located at the sides. At these joints said lateral members are placed as follows at each one of said structural joints:

a. The lateral member that corresponds to the element having the function of front legs, is placed at the outermost plane, that is to say, at the external part.

b. The lateral member that corresponds to the element having the function of seat-frame is placed at the innermost plane.

c. The lateral member corresponding to the element having the function of back legs is located at an intermediary plane, that is to say, between the two members mentioned above.

The conventional deflectable chairs, constituted by means of the combination of said tubular elements, all present the disadvantage that the devices or mechanisms that perform the lateral joining of said three tubular elements, generally protrude, in the shape of lateral projected parts that cause great trouble when carrying or storing the chairs, such as occupying a large volume because of said lateral protruding parts. Moreover, said lateral protruding parts act as obstacles over which people can involuntarily stumble on walking near the chairs while open or unfolded.

Taking into account the problems and inconveniences mentioned in the paragraph above, the present invention discloses a joining device for the three elements that constitute the general frame of the deflectable chairs usually known as "scissors"-type. Said joining device is built in a way such that by itself it permits a total flatness of the sides of the chair; that is to say, without any kind of protruding part, whether the chair is folded or unfolded (open).

Basically, the joining device object of the present invention, according to a first and preferable way of embodiment, is constituted by two prismatic pieces, identical in shape and size, one of which is partially inlaid and fixed to the internal face of the respective lateral members corresponding to the tubular element having the function of front legs and backboard, while the other is placed in identical manner (but facing the former) on the internal face of the respective lateral members corresponding to the element having the function of seat-frame.

Both said prismatic elements are affected on the sides thereof facing each other by a mortising having a circular contour, open at a side following two straight and stepped tracks.

Said mortisings jointly determine a housing for the corresponding lateral member of the element having the function of back legs. Said end of the lateral member corresponding to the back legs, is shaped by means of a rectangular prismatic protruding part the thickness of which is exactly twice the depth of each one of the mortisings belonging to the prismatic elements. Also, said prismatic protruding part of a rectangular shape presents on both supporting faces at the innermost part of the mortisings, two cylindrical emerging parts which are designed to fit into holes provided to that purpose in said prismatic pieces or elements.

In this way, the above-mentioned cylindrical projected parts constitute a rotation axis for the balancing of the three tubular elements that meet in said structural joint, conformed by said two prismatic pieces affected by mortisings and the rectangular prismatic end of the respective lateral member corresponding to the element having the function of back legs.

Therefore, said end or rectangular prismatic prolonged part can tilt inside the housing formed by the facing mortisings belonging to the prismatic parts, in virtue of which tilting the user can fold or unfold the chair, since each prismatic element, and with it, the respective lateral member on which it is fixed, can tilt with regard to the member corresponding to the back legs and vice-versa; that is to say, the tilting of the latter with respect to both prismatic elements.

The limit folding and unfolding of the chair is determined by the stops which, placed against the lateral flat faces of the rectangular prismatic end belonging to the back legs, determine the straight-lined tracks found on each one of the lateral openings of the mortisings of the prismatic parts.

Consequently, with the above-mentioned structural joint device, the fact that the sides of the chair have no projected parts as the joining devices of conventional deflectable chairs have, is achieved.

Another way of embodiment or variant of the structural joint device conformed according to the present invention, consists in the elimination of the prismatic pieces that are partially inlaid and fixed to the lateral mamabers that belong to the element having the function of front legs and backboard, and belonging to the element having the function of seat-frame.

The eleimination of said prismatic parts is achieved by means of three elongated and flat-iron shaped bodies with rounded edges, which are related to each other determining the structural joint device placed at each side of the chair, and said three elements are intended to fit or plug in the corresponding extreme portions of the tubular elements that concur at said structural joint and have the function of front legs and backboard, the function of seat-frame, and the function of back legs.

Thus a greater simplicity when mounting the elements conforming the chair is attained, since in the first embodiment described above of the structural joint device it becomes necessary to fix by adequate means the prismatic elements on the corresponding lateral members of the elements that constitute the frame of the chair, which demands its own time and technique, whereas with the structural joint device described in the second way of embodiment, the assembly of the chair is performed in a very simple way, as it only requires the fitting or plugging into the corresponding tubular portions concurring at the structural joints, of the elongated and flat-iron shaped bodies.

In this second variant or way of embodiment of the structural joint device, the flat-iron shaped elements that are intended to be plugged into the lateral memebers of the element having the function of front legs and backboard, and the element having the function of seat-frame, present the intermediate areas thereof with a larger diameter, so that on the internal faces thereof, which face each other, they are provided with mortisings tending to circular in shape but having in diametrical opposition, angular recesses of a considerable amplitude. Said mortisings house lateral projected parts placed on the corresponding, also having larger diameter, end of the flat-iron shaped body intended to plug into the lateral memebers having the function of back legs. Said projected parts have a rombic contour with rounded smaller corners, which permits the tilting and limited rotation of the three elements with regard to one another, when the chair is being folded or unfolded. The rotation axis for said three elements is constituted by a pin housed in the three facing holes provided at the areas of the three flat-iron shaped bodies that have a larger diameter.

With the object of facilitating a better understanding of the characteristics described above, corresponding to the object of the present invention, attached to the present specification is a set of drawings in which, only to illustrate and never to be considered restrictive, the following is shown:

FIG. 1. Shown is a perspective and to-pieces view of the structural joint device corresponding to one of the lateral memebers of the chair, according to the first way of embodiment. Said view permits to observe the concurring portions at the structural joint itself; said portions belonging to the lateral members of the three elements that constitute the general frame of the chair, two of the members of which have partially inlaid and fixed, the prismatic parts from the mortisings in which the end of the other member, which is placed between the other two mentioned above, on which said prismatic pieces are fixed, is housed.

Figure 2:
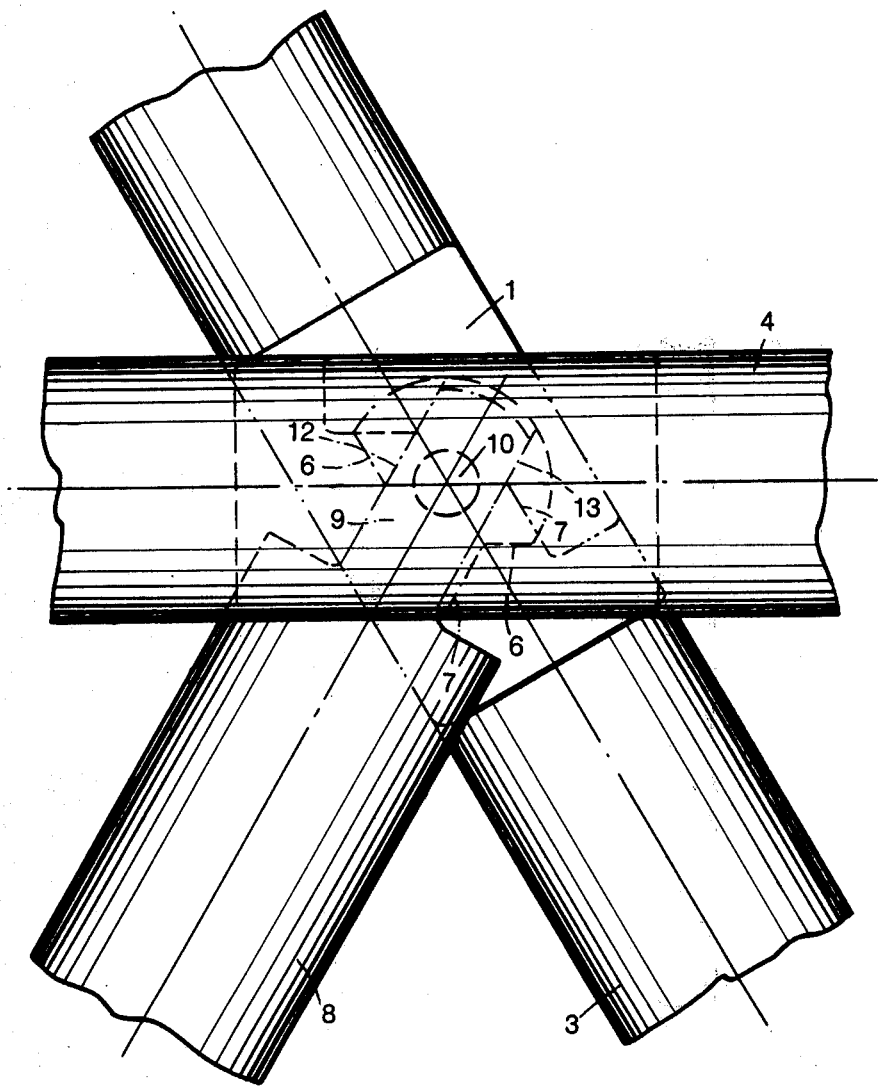

FIG. 2. Shows a side view of the joint device that corresponds to one of the two sides of the chair and constituted according to the first way of embodiment. The contour of the mortising corresponding to the prismatic piece fixed to the member belonging to the element having the function of back legs is represented by the dashed line. The dot-and-dash line represents the contour of the prismatic rectangular end corresponding to the memeber belonging to the element having the function of back legs. The two-dot-and-dash line represents the contour of the mortising corresponding to the prismatic piece fixed to the memeber belonging to the element having the function of front legs and backboard.

Figure 3:
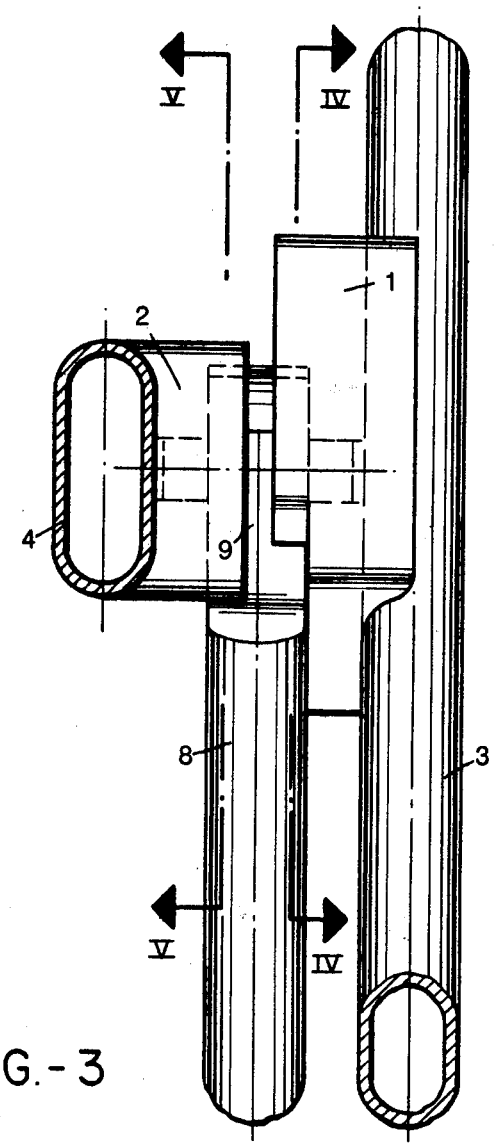

FIG. 3. Shows a front view of one of the two lateral structural joint devices that join the three elements that constitute the general frame of the chair, said structural joint corresponding to the first way of embodiment of the device object of the present invention.

Figure 4:
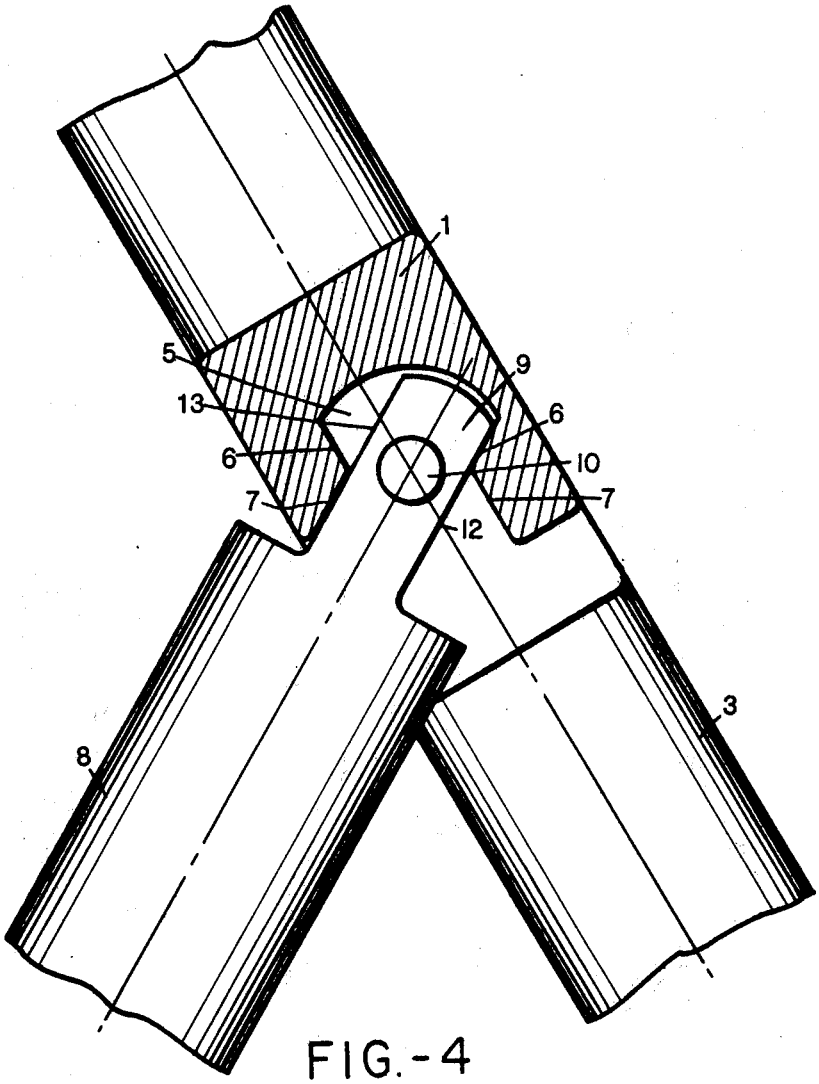

FIG. 4. Shows a sectional view along A–B represented in FIG. 3.

Figure 5:
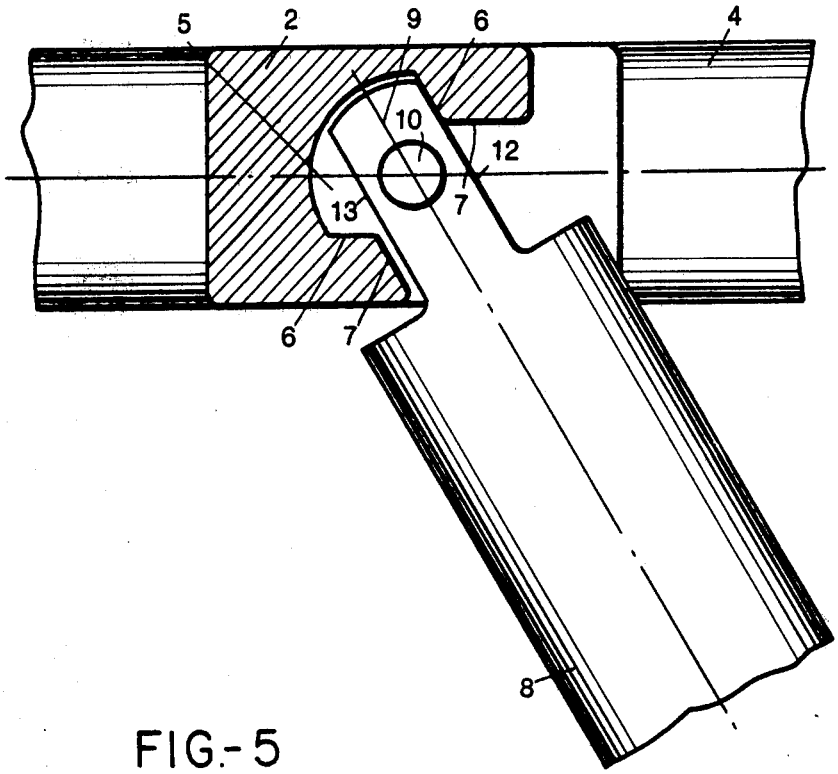

FIG. 5. Shows a sectional view along C–D represented in FIG. 3.

Figure 6:
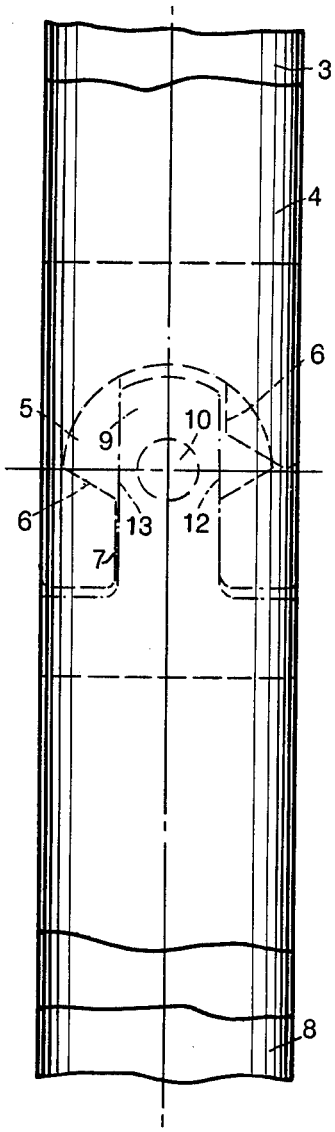

FIG. 6. Shows a lateral view of the structural joint of the three tubular elements that conform the frame of the chair, said structural joint corresponding to the first way of embodiment of the present invention.

Figure 7:
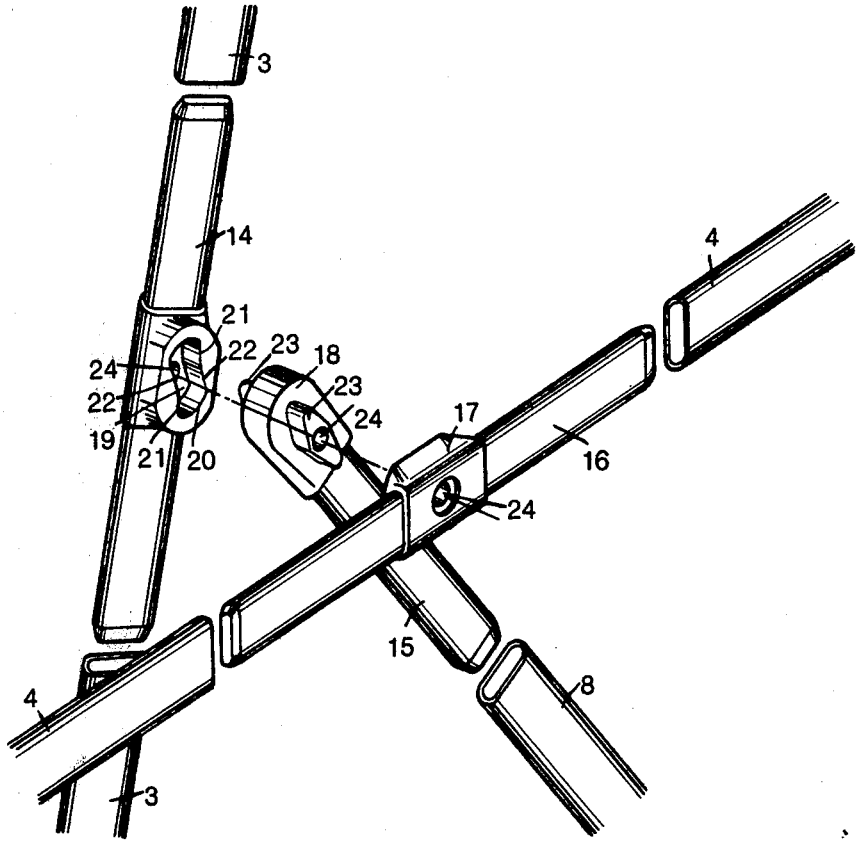

FIG. 7. Shows a perspective and to-piece view of the three flat-ironed shaped bodies that constitute the joint device according to the second way of embodiment.

Figure 8:
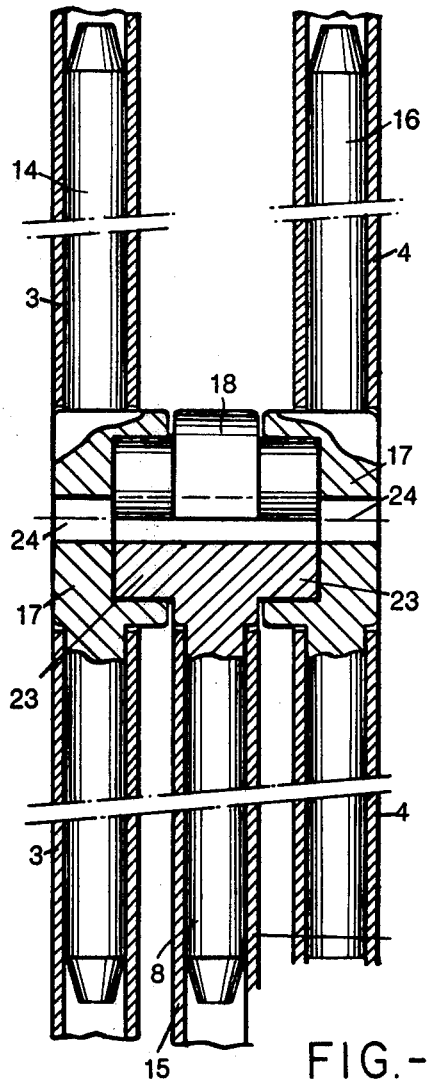

FIG. 8. Shows a front-sectional view of the joint constituted by the three flat-iron shaped bodies represented in FIG. 7, which are housed or plugged into the extreme portions of the lateral memebers that concur at the structural joint itself and belong to the tubular elements that constitute the frame of the chair.

Figure 9:
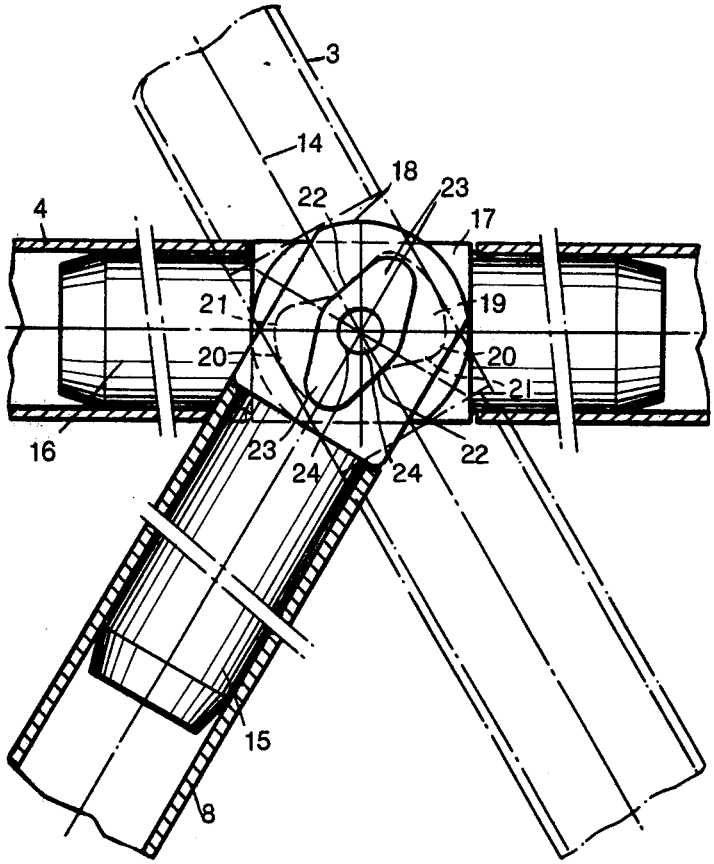

FIG. 9. Shows a side-sectional view of the three flat-iron shaped bodies that constitute the joint device according to the second way of embodiment; said flat-iron shaped bodies are shown in the position that corresponds to the open or unfolded chair.

Figure 10:
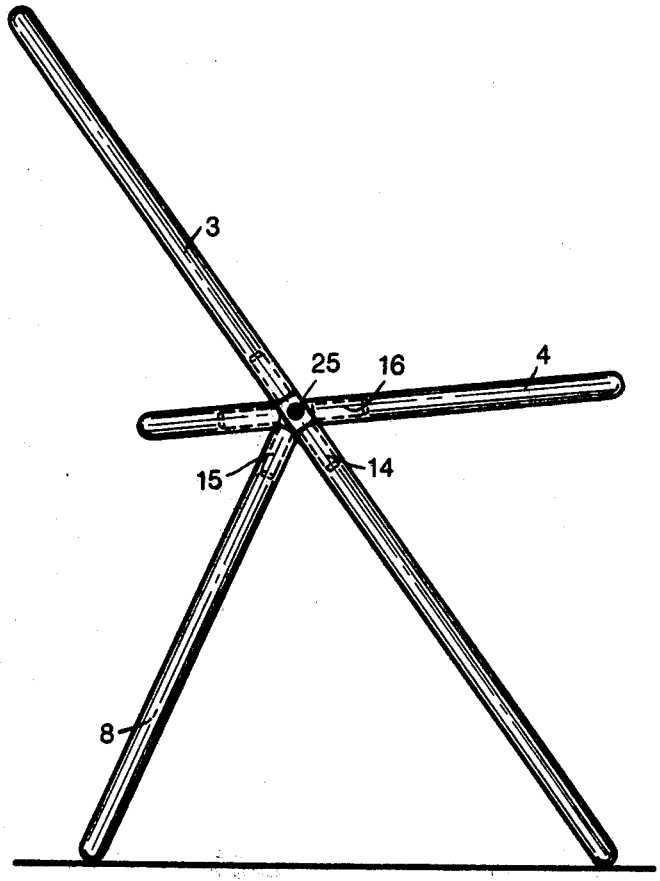

FIG. 10. Shows a side view of a deflectable chair to which the joint device, built according to the second way of embodiment, has been applied.

In view of the above described figures, the joint device for deflectable chairs according to the first way of embodiment, as shown in the drawings corresponding to the first six figures, is built from two prismatic pieces (1 and 2), which are partially inlaid and fixed respectively to the lateral members (3 and 4) belonging to the tubular element having the function of front legs and backboard, and to the tubular element having the function of seat-frame.

Said prismatic pieces (1 and 2) are placed and fixed on the internal facing sides of said two memebers (3 and 4). Each one of said prismatic pieces (1 and 2) is provided with a mortising (5) having a circular contour open at one side, the opening of each mortising being limited laterally by a pair of flat stepped surfaces (6 and 7) that constitute the prolonged part of the lateral bent surface of the respective mortising (5).

The facing disposition of said mortisings (5) determines a housing for the end of the lateral intermediary member corresponding to the tubular element (8) having the function of back legs. Said end is constituted by a prolonged part, rectangular-prismatic in shape (9), with a rounded free end, which determines a bent surface that will be in permanent contact with the supporting bent surface internally placed of the respective mortising (5); from the side faces of said rectangular-prismatic projected part (9) that will be supported by the flat bottom of the mortisings (5), protrude two cylindrical fingers (10) intended to fit into corresponding holes (11) made to that purpose in the flat bottom of the morstisings itself (5).

In this way, the joint of the three tubular elements that constitute the frame of the chair, is performed on each one of the two sides of the chair itself, so that each one of the prismatic pieces (1 and 2), and with them the corresponding lateral members (3 and 4) on which they are fixed, can perform a tilting motion, that is limited with regard to the end of the prismatic projected part (9), in order to make possible the folding and unfolding of the chair.

That is to say, in order to unfold the chair, for example, when said chair is folded, obviously it will be necessary to pull in opposite directions the tubular elements having the function of front legs and backboard and the function of seat-frame, so that the corresponding lateral members thereof (3 and 4) will tilt around the rotation axis constituted by the fingers (10). Said tilting or rotation takes place with regard to the end or prismatic projected part (9) belonging to the member (8) that makes part of the tubular element having the function of back legs. The tilting or rotation of both mentioned prismatic pieces (1 and 2) and consequently of the lateral members (3 and 4) is limited, so that the unfolding of the chair reaches only preestablished extents. Said limits in the tilting of the lateral members (3 and 4), and consequently, in the degree of unfolding of the chair, are determined by the fact that the lateral faces (12 and 13) corresponding to the prismatic prolonged part (9) will stop at the corresponding flat surfaces (6 and 7), as can be clearly observed in FIGS. 2., 4., and 5. In this way, the chair will be totally open or unfolded, without any possibility of shutting itself when sitting on it, since the stops determined by the lateral faces (12 and 13) against the flat surfaces (6 and 7) corresponding to the lateral opening of the mortisings (5), prevent the chair from folding and besides from opening or unfolding any further.

In order to perform the folding of the chair, the operation is performed in reverse manner to that of unfolding. Said folding of the chair is also limited by stops that in this case are constituted by the flat surfaces (6 and 7) opposite to the ones mentioned above, and where the lateral faces (12 and 13) corresponding to the rectangular-prismatic projected part (9) will stop, as can be seen in FIG. 6.

As for the second way of embodiment for the joint device for folding or deflectable chairs, same is represented in FIGS. 9 and 10.

In this second way of embodiment, the joint device itself is constituted from three elongated and flat-iron shaped bodies (14, 15 and 16). The flat-iron shaped bodies (14 and 16) are identical and present a central zone (17) that is thicker, while the flat-iron shaped body (15) is half as long as the two above, also having a thicker area (18) that corresponds to one of the ends of said flat-iron shaped body (15). Said thicker zones (17 and 18) are provided with the corresponding means to interrelate the three flat-iron shaped bodies and constitute the joint devices themselves for each side of the chair.

The flat-iron shaped body (14) is intended to fit or plug into the corresponding lateral member (3) of the element having the function of front legs and backboard, while the flat-iron shaped body (16) is also intended to fit or plug into the corresponding lateral memeber (4) of the tubular element having the function of seat-frame. As the above-mentioned flat-iron shaped bodies (14 and 16) present two plugging portions, separated by the central zone (17) that is thicker, undoubtedly the lateral members corresponding both to element (3) having the function of front legs and backboard, and to element (4) having the function of seat-frame, must be cut at the area that concurs on the structural joint itself, so that they will determine a pair of extreme portions into which the mentioned two portions of each flat-iron shaped body will fit or plug (14 and 16).

On the other hand, the flat-iron shaped body (15) presents an only plugging portion, since the tubular element having the function of back legs is built with a U-shaped profile and consequently said only portion of the flat-iron shaped body (15) can fit or plug into the corresponding end of the lateral memebers belonging to said tubular element (8) having the function of back legs.

In this way, in the coupling formed by said three flat-iron shaped bodies (14, 15 and 16), same will be placed in equal manner to that of the lateral memebers of the tubular elements that constitute the frame of the chair, the distribution of which was described when the first way of embodiment of the joint device was explained. That is to say, the flat-iron shaped body (14) will be placed at the exterior part of the structural joint, while the flat-iron shaped body (16) will be placed at the interior part, so the flat-iron shaped body (15) will be placed between the two bodies (14 and 16).

The facing surfaces of the central zones (17) corresponding to the flat-iron shaped bodies (14 and 16) are provided with a mortising (19) that has a tending to circular contour. Each one of said mortisings (19) is provided, in diametrical opposition and affecting the whole depth thereof, of one angular recess of great amplitude, causing the contour of the mortisings (19) to present two opposing bent surfaces (20) and two pairs of flat surfaces (21 and 22), also opposing each other.

The extreme end (18) having the largest diameter, belonging to the flat-iron shaped body (15), presents in surfaces facing the central zone (17) having a larger diameter and belonging to the flat-iron shaped bodies (14 and 16), one projected part (23) with rombic contour and rounded smaller corners. Said projected parts (23) are housed in the mortisings (19), permitting the rotation or tilting of each one of the flat-iron shaped bodies (14 and 16) with respect to the flat-iron shaped body (15) and vice-versa, to be limited. The rotation or tilting axis will be determined by a transversal pin (25) housed inside the three facing holes (24) made through the areas having a larger diameter (17 and 18) belonging to the repeated flat-iron shaped bodies (14, 15 and 16).

In said rotating or tilting motion of the flat-iron shaped bodies, the bent surface determined by the rounded corners corresponding to the projected rombic portions (23), will slide on the bent surfaces (20) of the mortisings (19), while the flat surfaces (21 and 22) of said mortisings will constitute the stops for maximum rotation or tilting motion on meeting against them the lateral flat surfaces of the rombic projected parts (23).

In this way, a structural joint is constituted for each side of the chair. Said structural joint presents the same operating principle as the one described in the first way of embodiment of the present invention, since the folding or unfolding of the chair will be performed in identical manner in both cases, with the only peculiarity that in this second way of embodiment the stops for maximum folding and unfolding of the chair are determined by the stops constituted by the corresponding flat surfaces (21 and 22) against the flat lateral faces of the projected rombic portions (23) housed inside the mortisings (19).

I claim:

1. A structural joint device for use in connecting and enabling relative folding and unfolding movement between tubular elements of a foldable chair of the type including a first element in the form of a rectangular frame and forming the front legs and backrest of the chair, a second element having a U-shaped profile and forming the rear legs of the chair, and a third element in the form of a rectangular frame and forming the seat frame of the chair, the three chair elements being foldably connected at each of opposite sides thereof by a said structural joint device which comprises:

a first elongated flat body having opposite end portions adapted to plug into confronting portions of a lateral member of the first tubular chair element and a central portion having a thickness greater than said opposite end portions;

a second elongated flat body identical in construction to said first flat body and having opposite end portions adapted to plug into confronting portions of a lateral member of the third tubular chair element and a central portion having a thickness greater than said opposite end portions;

each said central portion of said first and second flat members having a surface having therein a recess defined by diametrically opposite curved surfaces, opposite ends of which are joined by pairs of converging planar surfaces which are disposed generally in diametral opposition;

a third elongated flat body having a first end portion adapted to plug into an end of a lateral member of the second tubular chair element and a second end portion having a thickness greater than said first end portion, said second end portion having opposite side surfaces;

each said side surface of said second end portion of said third flat body having extending outwardly therefrom a projection having a rombic contour with rounded smaller corners;

said first, second and third flat bodies being assembled with said second end of said third flat body positioned between said central portions of said first and second flat bodies, with said recesses in said central portions of said first and second bodies facing each other, and with said projections on said opposite side surfaces of said second end portion of said third flat body extending into respective said recesses; and a pin extending through holes in said central portions, at positions symmetrical with said recesses, and in said second end portion, at a position symmetrical with said projections, said pin defining an axis of relative rotation between said first, second and third flat bodies.

2. A device as claimed in claim 1, wherein, during relative rotation between said flat bodies, said rounded smaller corners of said projections move in contact with respective said curved surfaces of said recesses, and wherein relative rotation in opposite folding and unfolding directions is limited due to abutment of respective planar surfaces of said projections with respective said pairs of planar surfaces of said recesses.

* * * * *